US007081705B2

(12) United States Patent
Hori et al.

(10) Patent No.: US 7,081,705 B2
(45) Date of Patent: Jul. 25, 2006

(54) LUMINESCENT DEVICE, DISPLAY DEVICE, AND DISPLAY DEVICE CONTROL METHOD

(75) Inventors: Kenya Hori, Okayama (JP); Masayuki Ono, Osaka (JP); Toshiyuki Aoyama, Osaka (JP); Masaru Odagiri, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 18 days.

(21) Appl. No.: 10/864,880

(22) Filed: Jun. 10, 2004

(65) Prior Publication Data

US 2005/0012104 A1 Jan. 20, 2005

(30) Foreign Application Priority Data

Jun. 13, 2003 (JP) ..... P2003-170087

(51) Int. Cl.
*H01J 1/62* (2006.01)

(52) U.S. Cl. ..... 313/509; 313/506

(58) Field of Classification Search ..... 313/506, 313/509

See application file for complete search history.

(56) References Cited

U.S. PATENT DOCUMENTS 2,875,380 A * 2/1959 Toulon ..... 345/76
2,969,481 A * 1/1961 Sack, Jr. ..... 345/80
5,523,639 A * 6/1996 Okamoto et al. ..... 310/309
5,725,801 A * 3/1998 Kitai et al. ..... 252/301.4 R
6,246,082 B1 * 6/2001 Mitarai et al. ..... 257/295
6,403,204 B1 * 6/2002 Kitai et al. ..... 313/509
2002/0064682 A1 5/2002 Yano et al.
2003/0197461 A1 * 10/2003 Fukuda et al. ..... 313/493
2004/0027048 A1 2/2004 Cheong et al.
2004/0227457 A1 * 11/2004 Yamashita ..... 313/503
2005/0122034 A1 * 6/2005 Yamashita ..... 313/503

FOREIGN PATENT DOCUMENTS

EP 1 207 722 A2 5/2002
WO WO 2004/036961 A2 4/2004

* cited by examiner

*Primary Examiner*—Nimeshkumar D. Patel
*Assistant Examiner*—Peter Macchiarolo
(74) *Attorney, Agent, or Firm*—McDermott Will & Emery LLP

(57) ABSTRACT

A luminescent device includes a phosphor layer containing a luminescent inorganic material, first and second dielectric layers rendering the phosphor layer therebetween from the direction perpendicular to the surface, the dielectric layers having residual dielectric polarization in part of at least 3 $\mu C/cm^2$ and a coercive electric field of at least 20 kV/cm, and first and second electrodes rendering the first and second dielectric layers therebetween from the direction perpendicular to the surface.

6 Claims, 9 Drawing Sheets

LUMINESCENT DEVICE, DISPLAY DEVICE, AND DISPLAY DEVICE CONTROL METHOD

TECHNICAL FIELD

The present invention relates to a luminescent device using a luminescent inorganic material, and to a display device using said luminescent device.

BACKGROUND ART

While flat panel displays made with LCD panels and plasma display devices are now common, flat panel displays made with electroluminescent display (EL) elements are relatively new. There are both inorganic EL devices that use an inorganic compound in the luminescent device, and organic EL devices that use an organic compound in the luminescent device.

EL device features include high speed response, high contrast, and vibration resistance. EL devices have no space inside, and can therefore be used in both high pressure and low pressure environments.

Organic EL devices operate with a low drive voltage and produce a number of gradations when used in a TFT active matrix display, but these devices are susceptible to the effects of humidity and have a short service life.

Compared with organic EL devices, inorganic EL devices are easier to manufacture because the luminescent devices are made from inorganic materials. Inorganic EL devices also feature a long service life, good vibration resistance, and can be driven with AC power. However, inorganic EL devices require a high voltage to luminesce, and are therefore difficult to drive in a TFT active matrix display. Inorganic EL devices are therefore driven in a passive matrix.

Passive matrix displays have multiple scanning electrodes extending parallel to a first direction, and multiple data electrodes extending parallel to a second direction that is perpendicular to the first direction. An AC voltage is applied between a scanning electrode and data electrode pair to drive one luminescent device. The luminescent devices are sandwiched between intersecting scanning electrodes and data electrodes. A problem with this passive matrix drive method is that the overall luminescence of the display device decreases as the number of scanning electrodes increases.

Japanese Examined Patent Publication No. S54-8080 teaches doping a phosphor layer of primarily ZnS with Mn, Cr, Tb, Eu, Tm, or Yb, for example, to improve light output and improve the peak luminance, but the average luminance is less than 400 cd/m$^2$ and this display produces fewer than 256 gradations. It is therefore unsuitable for use as a display device for televisions, for example.

When luminescent devices are used as a display device for televisions, for example, the screen will be darker than an LCD panel if the luminance of the luminescent devices is not at least 400 cd/m$^2$. The luminance of luminescent devices used in such displays must therefore be 400 cd/m$^2$ or more.

Furthermore, when luminescent devices are used in televisions and other such display devices, 256 gradations or more are required. In conventional passive matrix display devices using inorganic EL devices that use an inorganic compound for the luminescent device, there is a sharp change in luminance relative to the applied voltage as shown by the dotted line representing a prior art device in FIG. 4. The difference between this threshold voltage and the voltage achieving the maximum peak luminance is small, and because graduated control of light output by means of external electric field control is either very difficult or impossible, it has not been possible to develop a viable display device that can be used in televisions, for example.

An object of the present invention is therefore to provide a luminescent device that provides both sufficient brightness and enables 256-level gray scale control.

DISCLOSURE OF INVENTION

To achieve this object, a luminescent device according to the present invention has a phosphor layer containing a luminescent inorganic material; first and second dielectric layers sandwiching the phosphor layer therebetween in the direction perpendicular to the layer surface; and first and second electrodes sandwiching the first and second dielectric layers therebetween in the direction perpendicular to the layer surface.

The first and second dielectric layers of this luminescent device are characterized by residual dielectric polarization of 3 μC/cm$^2$ or greater in at least part, and a coercive electric field of 20 kV/cm or greater.

In another aspect of the present invention, there is a luminescent device including a phosphor layer containing a luminescent inorganic material, a dielectric layer provided on a surface of the phosphor layer, the dielectric layer having residual dielectric polarization in part of at least 3 μC/cm$^2$ and a coercive electric field of at least 20 kV/cm, and first and second electrodes rendering the phosphor layer and the dielectric layer therebetween from the direction perpendicular to the surface.

This luminescent device is an inorganic EL device using a luminescent inorganic material. This inorganic EL device has a ferroelectric layer composed of a ferroelectric material formed on at least one side of the phosphor layer. We discovered that this phosphor layer emits light relative to an external electric field applied thereto, but if the ferroelectric layer is provided on at least one side of the phosphor layer, the luminescent material can be forced to emit by the residual polarization of the ferroelectric material for a certain period of time in which an external electric field is not applied. The resulting luminescent device features a long on time, high luminescence, and excellent luminance.

This luminescent device preferably has a support substrate supporting one surface of the first electrode or second electrode.

It also preferably has a control unit for controlling the AC voltage applied between the first and second electrodes.

A display device according to the present invention has a luminescent device array composed of a plurality of luminescent devices described above arranged in a two-dimensional matrix; a plurality of first electrodes extending parallel to a first direction that is parallel to the surface of the luminescent device array; and a plurality of second electrodes extending parallel to a second direction that is perpendicular to the first direction and parallel to the surface of the luminescent device array. This display device is characterized by driving at least one luminescent device by applying an AC voltage between one first and second electrode pair.

A control method for a display device having a luminescent device array composed of a plurality of luminescent devices arranged in a two-dimensional matrix, a plurality of first electrodes extending parallel to a first direction that is parallel to the surface of the luminescent device array, a plurality of second electrodes extending parallel to a second direction that is perpendicular to the first direction and parallel to the surface of the luminescent device array, and driving at least one luminescent device by applying an AC voltage between one first and second electrode pair, is characterized by having steps of: driving the luminescent devices by applying alternating positive and negative external electric fields between the first electrodes and second electrodes, and scanning the entire luminescent device array; and controlling the strength of the electric field applied in the next scan according to the strength of the electric field applied in the previous scan and the hysteresis characteristic of the ferroelectric forming the ferroelectric layer.

The components of a luminescent device according to the present invention are described next.

This luminescent device can be fixed on a support substrate. A material with excellent electrical insulation properties is used for this support substrate. A support substrate made from a material with high transparency in the visible light spectrum is used so that light from the luminescent device can be extracted from the support substrate side. If the temperature of the support substrate reaches several hundred degrees centigrade during the manufacturing process, a material with a high softening point, excellent heat resistance, and a thermal expansion coefficient comparable to the film on which it is laminated is used.

Glass, ceramic, and silicon wafers can be used for this support substrate material, but a non-alkali glass can also be used so that the alkali ions contained in normal glass do not affect the luminescent device. Furthermore, the glass surface could be coated with alumina, for example, as an ion barrier layer between the alkali ions and luminescent device.

For the electrodes, a material with high electrical conductivity, good adhesion to the insulation layer, no ion migration caused by a strong electric field, and that does not causing shorting between opposed electrodes due to evaporation or other physical change during dielectric breakdown is used. The electrodes could be aluminum, molybdenum, or tungsten, for example. In addition to the electrode properties described above, the electrodes on the side from which light from the luminescent device is extracted preferably have good transparency in the visible light spectrum, and can be made from indium oxide doped with tin oxide (ITO), indium zinc oxide (InZnO), zinc oxide (ZnO), tin dioxide ($SnO_2$) or an alloy of Mg and Ag, for example, formed as a superthin film in order to provide transparency to visible light.

The dielectric preferably features high electrical insulation properties and a high dielectric constant to prevent breakdown of the luminescent device when a strong electric field is applied. It is also preferably free or substantially free of pinholes and defects to further prevent luminescent device breakdown. The dielectric is also laminated with the phosphor layer and electrodes, and therefore preferably features good adhesion. The dielectric should also be easily manufactured to a large size with uniform film thickness and film properties suitable for use in a display, should provide high heat resistance if high temperature processes are required for luminescent device manufacture, and should be made from a material that is transparent to visible light in order to obtain light from the luminescent device. A non-propagating dielectric that prevents dielectric breakdown from spreading throughout the luminescent device is also preferred. Examples of such dielectrics are dielectric materials of which a ferroelectric is the primary constituent. Dielectrics of which barium tantalate, yttrium oxide, barium titanate, tantalum oxide, strontium titanate, or zirconium oxide is the ferroelectric can be used. Such dielectrics make it possible to achieve a luminescent device in which the on time increases and light output increases as residual dielectric polarization Pr increases and the coercive electric field Ec increases.

The ferroelectric can be formed as a film by such methods as sputtering, electron beam (EB) vapor deposition, CVD, screen printing, and spin coating, and the resulting films can be heat treated to adjust the Pr and Ec of the ferroelectric film. To efficiently extract light emitted from the luminescent device, the film surface can be smoothed by polishing, or the film can be coated with a smoothing film. The Pr and Ec of the ferroelectric can be adjusted by controlling the thickness of the ferroelectric film.

The characteristics of the ferroelectric layer are described next with reference to FIG. 3. FIG. 3 is a hysteresis diagram of ferroelectric layer polarization P and the electric field E applied to the ferroelectric layer. By applying a potential to both sides of the ferroelectric layer and then applying a specific electric field, the azimuth of the electric dipoles in the ferroelectric layer is aligned with the electric field, indicating the overall polarization of the ferroelectric layer. A ferroelectric exhibits strong polarization at the point of saturation (state B) even when a weak electric field is applied. Polarization is retained (state C) even when the applied electric field strength goes to 0, the polarization at this time is called the residual dielectric polarization Pr. Furthermore, when an opposite electric field is then applied, polarization goes to 0 at a specific electric field strength (−Ec). The electric field strength at this time is the coercive electric field Ec. When an opposite electric field is applied again, polarization in the opposite direction saturates (state E), and when the applied electric field again goes to 0, the residual dielectric polarization is in the opposite direction (state F).

We discovered that a high luminance luminescent device and display device can be achieved by using a ferroelectric with high residual dielectric polarization and a strong coercive electric field in dielectric layer 3 and/or dielectric layer 5 shown in FIG. 1. More specifically, we discovered that, referring to the diagram of ferroelectric hysteresis shown in FIG. 3, the luminescent device emits brightly as the residual dielectric polarization increases because of the strong polarization accumulated in the ferroelectric, and the luminescent device continues to emit as the coercive electric field increases because the spontaneous polarization of the ferroelectric is held and maintained for a longer time.

The relationship between the luminance of the luminescent device, the residual dielectric polarization of the ferroelectric, and the coercive electric field is described in detail next.

FIG. 5 shows the time changes of current "i" and the resulting luminance of samples "a" and "b", when pulse "V" is applied as an external electric field to the luminescent device. The horizontal axis is time. Sample "a" shows the time change of the luminance of a conventional luminescent device, and sample "b" shows the time change of the luminance of a luminescent device according to the present invention. Note that while pulse "V" is applied as the external electric field in these examples, the invention shall not be limited to pulse applications as the external electric field.

Conventional luminescent device "a" continues to emit for only approximately 1 ms when a pulse or other external electric field is applied. Luminance is therefore low and the device is dim.

However, the luminescent device according to the present invention emits for five or more times longer than the conventional device because the polarization accumulated in the ferroelectric is both strong and sustained. Luminance is therefore high and a bright luminescent device is achieved.

Luminance and the coercive electric field Ec and residual dielectric polarization Pr of the ferroelectric are described next with reference to FIG. 6.

FIG. 6 shows the results of measuring luminance emission when the same external electric field was applied to luminescent devices manufactured using ferroelectric materials of different Ec and Pr values. When multiple luminescent devices having the same Ec but different Pr were compared, we found that luminance increases as Pr increases, but luminance was substantially the same for luminescent devices with a Pr less than 3 $\mu C/cm^2$. For luminescent devices with Pr of 3 $\mu C/cm^2$ or greater, luminance increases as Pr increases.

When multiple luminescent devices with the same Pr but different Ec were compared, we found that luminance increases as Ec increases. Pixel brightness necessary for a display device to be used in a television, for example, is 400 $cd/m^2$ or greater. From FIG. 6 we know that a luminescent device that produces at least 400 $cd/m^2$ can be achieved by using a ferroelectric with a Pr of at least 3 $\mu C/cm^2$ and Ec of at least 20 kV/cm in the dielectric of the luminescent device.

FIG. 4 shows the relationship between the external voltage applied to the luminescent device and the resulting luminance of this luminescent device.

The luminance of the present invention (shown in full line in FIG. 4) is higher than the luminance of prior art (shown in dotted line in FIG. 4). More specifically, a high luminance luminescent device is achieved by using a ferroelectric with residual polarization Pr of 3 $\mu C/cm^2$ or greater and coercive electric field Ec of 20 kV/cm or greater, since charged polarization in the dielectric layer becomes large so that effective electric field intensity for the phosphor layer becomes large and threshold voltage for luminescence can be dropped to lower, and duration time of luminescence can be extended due to continuance of polarization of the ferroelectric. To achieve an even brighter display device, the residual dielectric polarization Pr and coercive electric field Ec of the ferroelectric are preferably increased further. The slope of luminance relative to external applied voltage also becomes more gradual as shown in FIG. 4. As a result, we discovered that the luminance of the luminescent device can be controlled to 256 gradations by controlling the external applied voltage.

A control method for a display device according to the present invention is a method for controlling a display device 20 having a luminescent device array composed of a plurality of luminescent devices arranged in a two-dimensional matrix, a plurality of first electrodes 11 extending parallel to a first direction that is parallel to the surface of the luminescent device array, a plurality of second electrodes 12 extending parallel to a second direction that is perpendicular to the first direction and parallel to the surface of the luminescent device array, and driving at least one luminescent device by applying an AC voltage between one first and second electrode pair. The display device 20 to which this control method applies is preferably a display device as shown in FIG. 2.

This display device control method has steps of (a) driving the luminescent devices by applying alternating positive and negative external electric fields between the first electrodes and second electrodes, and scanning the entire luminescent device array, and (b) controlling the luminance by defining the strength of the electric field actually applied in the next scan according to the conversion table previously provided by inputting the strength of the electric field applied in the previous scan and the strength of the assumption electric field in the next scan as input information. The conversion table is provided in consideration of the residual polarization due to the hysteresis characteristic of the ferroelectric material. In the case of the luminescent device having double dielectric layers sandwiching the phosphor layer, at the same time of luminescing, discharged electrons from the interface between the phosphor layer and the one dielectric layer are incident to the phosphor layer by electric field. When the electron has reached to the other dielectric layer, the electron will be captured in deep trap of the interface so that residual charges will be formed. This is called as polarization effect. Therefore, the conversion table is provided in consideration of both the residual polarization due to the hysteresis characteristic of the ferroelectric material and the residual charges, so that high quality gray scale control can be achieved. Control of 256 gradations can thus be achieved by controlling the applied external electric field.

By using a ferroelectric material with residual dielectric polarization of 3 $\mu C/cm^2$ or greater in at least part, and a coercive electric field Ec of display device 20 kV/cm or greater, a luminescent device according to the present invention has a longer on time and therefore can produce luminance of 400 $cd/m^2$ or greater. Furthermore, the strength of the electric field is controlled by using the conversion table provided in consideration of both the residual polarization due to the hysteresis characteristic of the ferroelectric material and the residual charges so that control the luminance of the luminescent device in 256 gradations by controlling the applied external voltage can be achieved.

BRIEF DESCRIPTION OF DRAWINGS

The present invention will become readily understood from the following description of preferred embodiments thereof made with reference to the accompanying drawings, in which like parts are designated by like reference numeral and in which.

BEST MODE FOR CARRYING OUT THE INVENTION

Figure 1:
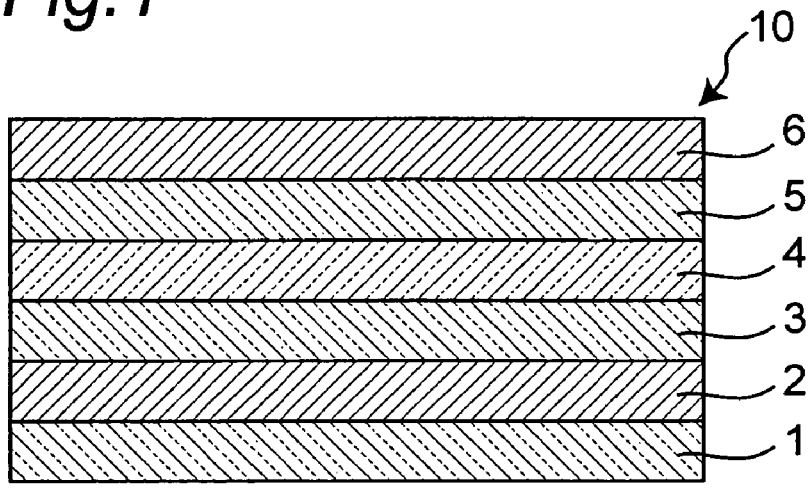
FIG. 1 is a section view of the construction of a luminescent device according to a first embodiment of the present invention.
Figure 2:
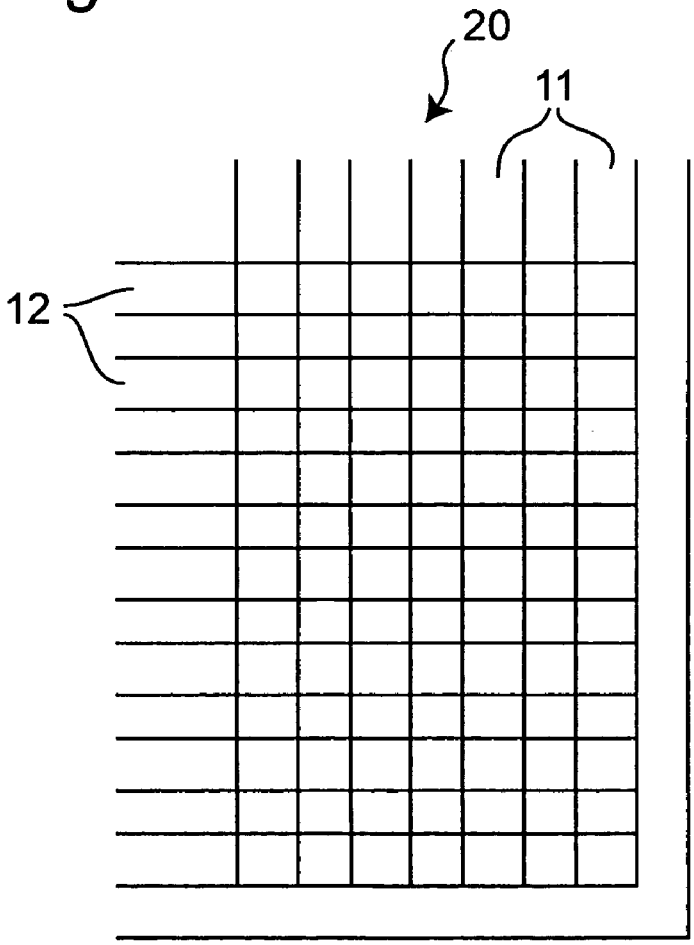
FIG. 2 is a plan view of the electrodes in a display device according to the first embodiment of the present invention.

Other objects and attainments together with a fuller understanding of the invention will become apparent and appreciated by referring to the following description and claims taken in conjunction with the accompanying drawings.

Preferred embodiments of a luminescent device according to the present invention are described in detail below with reference to the accompanying figures, but it will be obvious to one with ordinary skill in the related art that the invention shall not be limited to these embodiments. Note also that like parts are identified by like reference numerals in the figures.

FIRST EMBODIMENT

A luminescent device according to a first embodiment of the present invention is described below with reference to FIG. 1. FIG. 1 is a schematic section view of the structure of this luminescent device 10. This luminescent device 10 is an inorganic EL device using a luminescent inorganic material as the luminescent element. This luminescent device 10 has the phosphor layer 4 rendered between two dielectric layers (first and second dielectric layers 3 and 5), and these dielectric layers 3 and 5 are rendered between two electrode layers, that is, first electrodes 2 and second electrodes 6. Described with respect to the relative positions of these layers, this luminescent device 10 is manufactured by sequentially laminating to a support substrate 1: first electrodes 2, first ferroelectric layer 3, phosphor layer 4, second ferroelectric layer 5, and then second electrodes 6. The first electrode 2 is a metal electrode, and the second electrode 6 is transparent electrode. Therefore, luminescence from the luminescent inorganic material is output through the second electrode 6.

The emission characteristics of this luminescent device 10 are described next. Electrodes are taken from the Pd electrodes (first electrodes) 2 and transparent ITO electrodes (second electrodes) 6 of this luminescent device 10, and luminescence is achieved by applying an external electric field. Luminance 560 cd/m$^2$ is achieved by applying a 220 V external voltage between two electrodes.

Barium titanate is used for the ferroelectric in this first embodiment, producing a ferroelectric film with 4 μC/cm$^2$ residual dielectric polarization in a 20-kV/cm coercive electric field.

The components of a luminescent device 10 according to this first embodiment of the invention are described next below.

The material from which the support substrate 1 is made is not particularly limited, and plastic film, glass, ceramic, silicon wafer, or other material could be used. A non-alkali glass can be used for a heat resistant support substrate 1. If an alkali glass containing sodium or other alkali ions is used for the support substrate 1, the alkali ions could disperse into the luminescent film formed on the glass surface and lower the light emission characteristics of the device. To avoid this, soda-lime glass having an ion barrier film surface coating to prevent alkali ion dispersion can be used. Aluminum oxide is one material that can be used for the ion barrier film.

Various known materials can be used for the first electrodes 2 and second electrodes 6 with no specific limitations, but either or both of the first electrodes 2 and second electrodes 6 is made from a material that can pass light from the phosphor layer 4.

Barium titanate is preferably used for the ferroelectric forming the ferroelectric layers 3 and 5, but the invention shall not be so limited. Bismuth titanate, barium tantalate, zirconium oxide, yttrium oxide, tantalum oxide, and strontium titanate, lead titanate, lead titanate zirconate, samarium oxide, lead niobate, strontium titanate zirconate, sodium bismuth titanate, strontium bismuthate tantalate, strontium bismuthate niobate, barium bismuthate tantalate, barium bismuthate niobate, lead bismuthate tantalate, lead bismuthate niobate, calcium bismuthate titanate, strontium bismuthate titanate, barium bismuthate titanate, lead bismuthate titanate, sodium bismuthate titanate, potassium bismuthate titanate and mixtures thereof, are some other ferroelectrics that can be used. The ferroelectric could also be heat treated in order to increase the Pr and Ec ratings with the objective of increasing the luminescence (on) time.

Magnesium-doped zinc sulfide can be used as the luminescent inorganic material contained in the phosphor layer 4. The luminescent inorganic material shall not be so limited, however, and materials containing any of the following, for example, can be used: europium-doped calcium sulfide (650 nm wavelength emission), europium-doped calcium selenium sulfide (610 nm wavelength emission), europium-doped calcium yttrium sulfide (650 nm wavelength emission), samarium-chlorine doped zinc sulfide (650 nm wavelength emission), europium-doped calcium strontium sulfide (610 nm wavelength emission), europium-doped strontium yttrium sulfide (610 nm wavelength emission), europium-doped calcium magnesium sulfide 610 nm wavelength emission), manganese-doped zinc magnesium sulfide (575 nm wavelength emission), cerium-doped strontium sulfide, terbium-fluoride doped zinc sulfide (545 nm wavelength emission), terbium-fluoride oxide doped zinc sulfide (545 nm wavelength emission), terbium-doped zinc sulfide (545 nm wavelength emission), europium-doped strontium-gallium sulfide (530 nm wavelength emission), europium-gadolinium-doped calcium aluminum sulfide (520 nm wavelength emission), thulium-fluoride-doped zinc sulfide (475 nm wavelength emission), cerium-doped calcium gallium sulfide (460 nm wavelength emission), cerium-doped strontium gallium sulfide (445 nm wavelength emission), copper-doped strontium sulfide (480 nm wavelength emission), copper, silver-doped strontium sulfide (430 nm wavelength emission), lead-doped calcium sulfide (450 nm wavelength emission), europium-doped aluminum barium magnesium sulfide (440 nm wavelength emission), europium-doped aluminum barium sulfide (470 nm wavelength emission). Furthermore, the luminescence inorganic material may include at least one matrix material, and at least one activator which activates the matrix. The matrix material may be selected in the group of a compound between twelfth group of elements and sixteenth group of elements such as ZnS, ZnSe, ZnTe, CdS, CdSe, a compound between second group of elements and sixteenth group of elements such as CaS, SrS, CaSe, SrSe, ZnMgS, CaSSe, CaSrS, and mixed crystals thereof, and mixtures thereof having segregation, a thiogallate such as $CaGa_2S_4$, $SrGa_2S_4$, $BaGa_2S_4$, a thioaluminate such as $CaAl_2S_4$, $SrAl_2S_4$, $BaAl_2S_4$, metal oxides such as $Ga_2O_3$, $Y_2O_3$, CaO, $CeO_2$, $SnO_2$, ZnO, composite oxides such as $Zn_2SiO_4$, $Zn_2GeO_4$, $ZnGa_2O_4$, $CaGa_2O_4$, $CaGeO_3$, $MgGeO_3$, $Y_4GeO_8$, $Y_2GeO_5$, $Y_2GeO_7$, $Y_2SiO_5$, $BeGa_2O_4$, $Sr_3Ga_2O_6$, ($Zn_2SiO_4$—$Zn_2GeO_4$), ($Ga_2O_3$—$Al_2O_3$), ($CaO—Ga_2O_3$), ($Y_2O_3—GeO_2$). The activator may be selected in the group of metal elements such as Mn, Cu, Ag, Sn, Pb, Pr, Nd, Sm, Eu, Tb, Dy, Ho, Er, Tm, Yb, Ce, Ti, Cr, Al. Furthermore, the activator may be selected in the non-metal elements such as chlorine Cl, Iodine I and fluorides such as $TbF_2$ and $PrF_2$. The activator may be a mixture of at least two activators.

The phosphor layer 4 can be deposited by sputtering, EB vapor deposition, resistive heating vapor deposition, chemical vapor deposition (CVD), and another known deposition method. The phosphor layer 4 may be deposited in the gas such as air, $N_2$, He, Ar, and a mixture gas, while heating. The phosphor layer may be also heated in the gas after deposition. Therefore, crystallization of the phosphor layer 4 can be improved, so that luminescent device can have higher luminance.

A method of manufacturing this luminescent device 10 is described next. This luminescent device 10 was manufactured using the following steps.

(a) A non-alkali substrate was used for the transparent support substrate 1, which is 1.7 mm thick.

(b) A Pd electrode paste was printed to form the first electrodes on substrate 1. The paste was then dried to acquire a substrate with a first electrode pattern 2.

(c) A ferroelectric layer (first ferroelectric layer 3) of barium titanate ($BaTiO_3$) was then sputtered over the first electrode pattern 2 to form the first ferroelectric layer 3. The coercive electric field Ec of this dielectric layer is approximately 20 kV/cm and the residual dielectric polarization Pr is approximately 4 $\mu C/cm^2$.

(d) A manganese-doped zinc sulfide phosphor layer 4 was then formed by EB vapor deposition on the resulting first ferroelectric layer 3.

(e) A ferroelectric layer (second ferroelectric layer) 5 of barium titanate was then sputtered onto the manganese-doped zinc sulfide phosphor layer 4.

(f) An ITO transparent electrode layer 6 was then formed on the second ferroelectric layer 5 by RF magnetron sputtering using an ITO target.

The luminescent device 10 was formed by these processes.

A display device having a plurality of these luminescent devices in a two-dimensional matrix is described next. More specifically, this display device has a luminescent device array comprising a plurality of these luminescent devices in a two-dimensional arrangement, a plurality of first electrodes extending parallel to a first direction that is parallel to the surface of the luminescent device array; and a plurality of second electrodes extending parallel to a second direction that is perpendicular to the first direction and parallel to the surface of the luminescent device array. This display device drives at least one luminescent device by applying an external AC voltage between one first and second electrode pair.

Gray scale control of this display device is achieved by controlling the potential of the electric field applied in the next scan according to the potential of the electric field applied in the previous scan and the hysteresis characteristic of the ferroelectric forming the ferroelectric layer.

Figure 3:
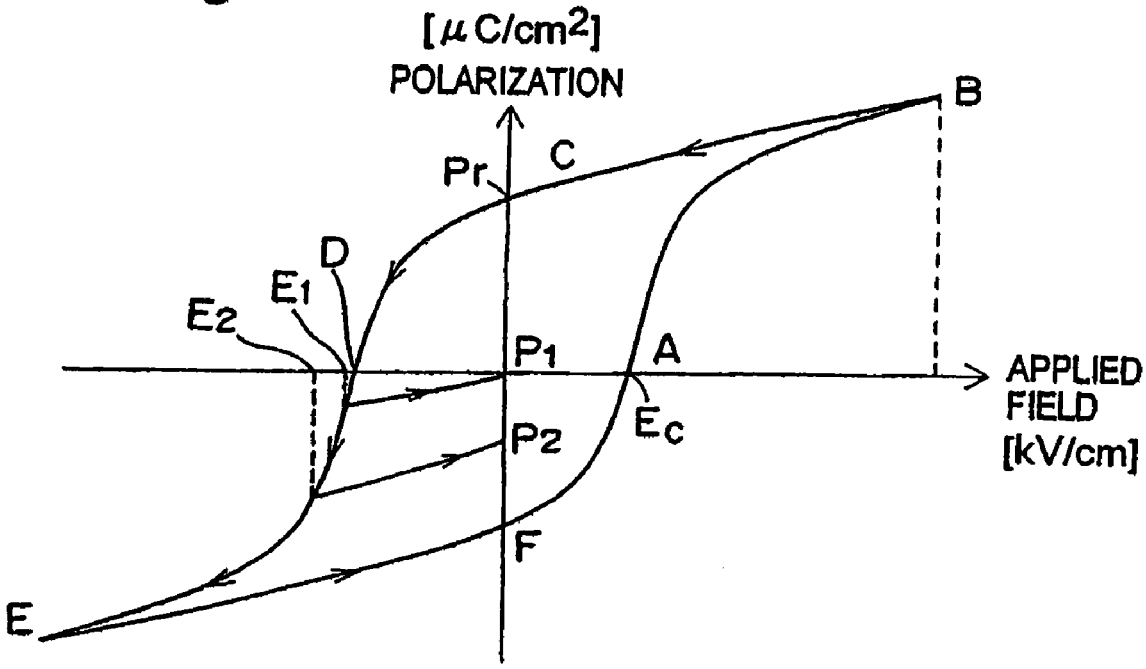
FIG. 3 is a graph of the hysteresis curve of the applied external electric field and polarization of the ferroelectric layer.

More specifically, after applying a positive pulse to the ferroelectric when scanning frame n−1, the ferroelectric retains residual dielectric polarization Pr as shown in the hysteresis chart in FIG. 3 even after the applied electric field goes to zero. This works as a so-called frame memory function. However, because there is residual dielectric polarization when the applied electric field goes to zero, the polarization achieved when an opposite external electric field is applied will be different from that achieved when the electric field is initially applied. For example, if the desired gray level in the next frame n is 0, the corresponding residual dielectric polarization is zero (P1). An opposite coercive electric field E1 slightly stronger than coercive electric field Ec must therefore be applied. In addition, an opposite electric field of E2 must also be applied in order to achieve residual dielectric polarization P2 that is half Pr. It is thus necessary to control the applied electric field according to a minor loop inside the hysteresis curve in order to achieve the desired gradation.

Figure 7:
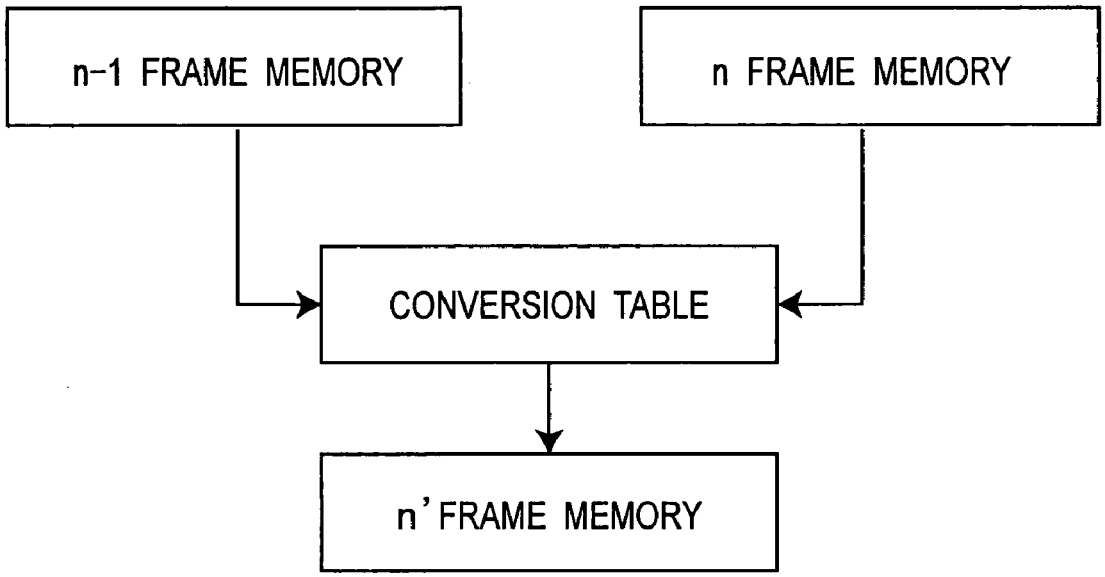
FIG. 7 is a flow chart of the gray scale correction block.

FIG. 7 is a flow chart of scanning frame n after scanning frame n−1. The conversion table shown in FIG. 7 is the applied electric field conversion table described above. More specifically, 256 gray scale control is possible by referencing this conversion table between frames n−1 and n to control the voltage or pulse height of the external electric field applied when scanning frame n' according to the voltage or pulse height of the external electric field applied to the data electrode when scanning frame n−1.

More specifically, 256 gray scale control is possible by controlling the applied external electric field by providing a frame memory function in a display device having luminescent devices according to the present invention.

Figure 8:
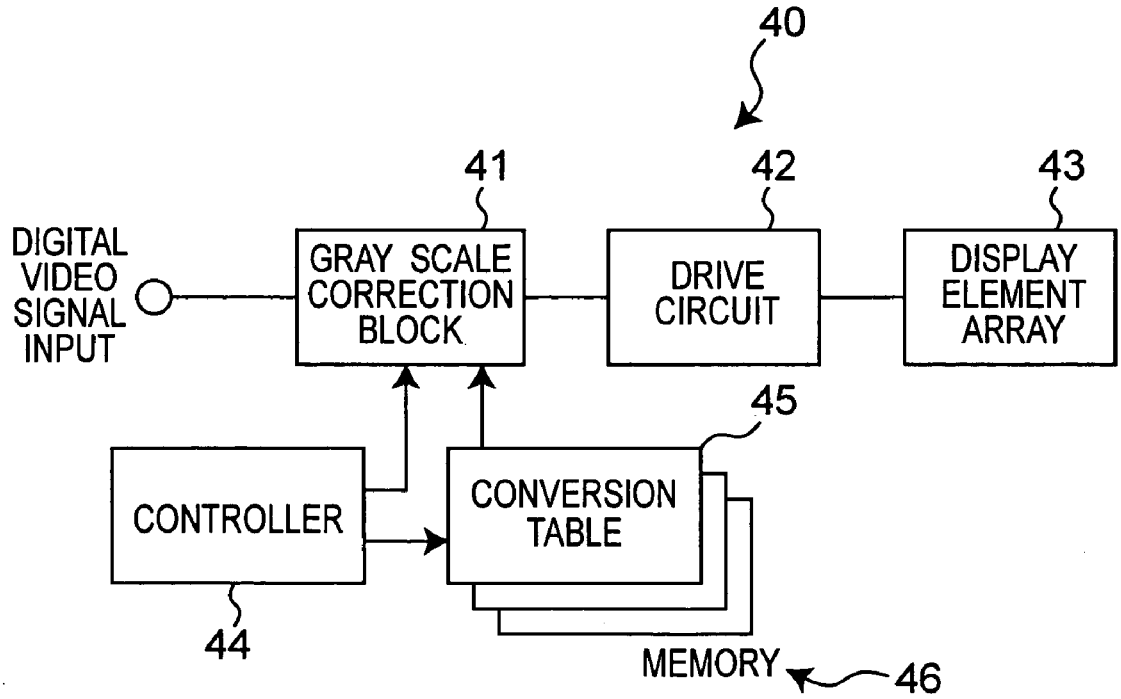
FIG. 8 is a block diagram of a display device.

FIG. 8 is a block diagram of the display device having a gray scale correction block 41, a drive circuit 42, a display element array 43, a controller 44, and a memory 46 that storages conversion table 45. The input digital video signal is corrected in the gray scale correction block 41, shown in detail in FIG. 7, and then passed to the display element array 43 through the drive circuit 42 of the present invention to achieve a bright picture.

Figure 10:
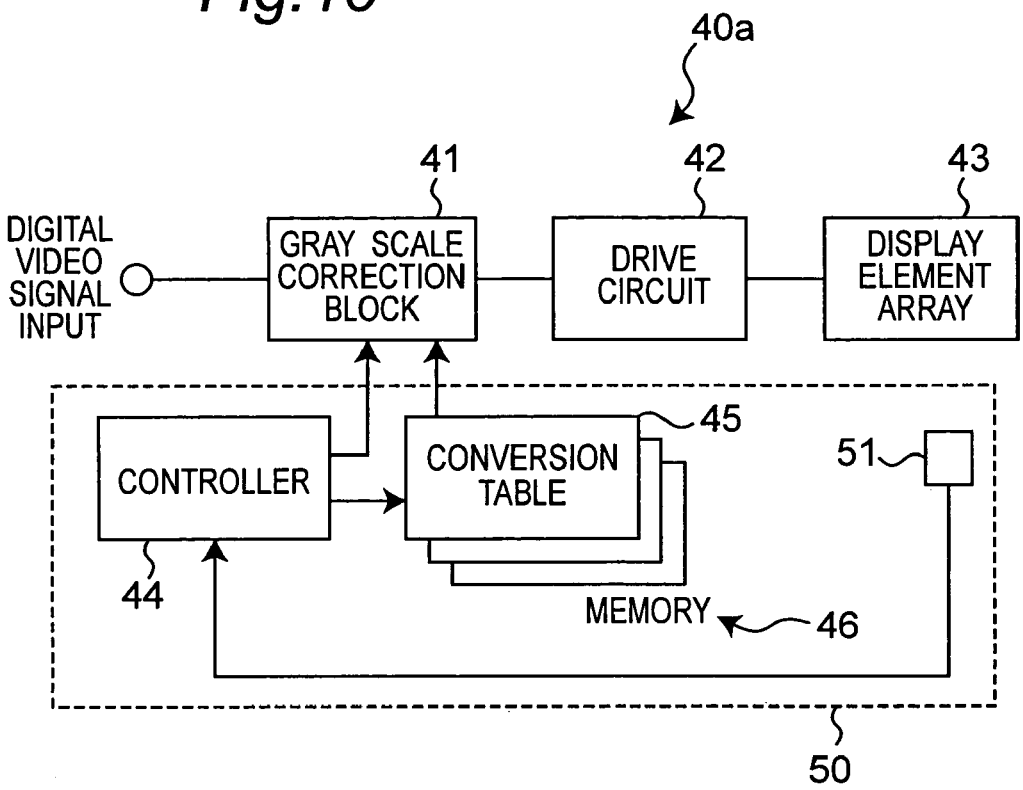
FIG. 10 is a block diagram of a display device having a background brightness compensating means.

The luminescent device may have another compensating means as shown in FIGS. 10 to 13. For example, firstly, a background brightness compensating means 50 having a background brightness detecting means 51 and a controller 44 which switches the conversion table 45 according to the background brightness determined may be provided as shown in FIG. 10. In this case, considering display properties changing due to the background brightness, and providing another conversion table compensated as the applied electric field to the luminescent device, therefore, good display properties responding to the background brightness and effective utilization of electric power can be achieved.

Figure 11:
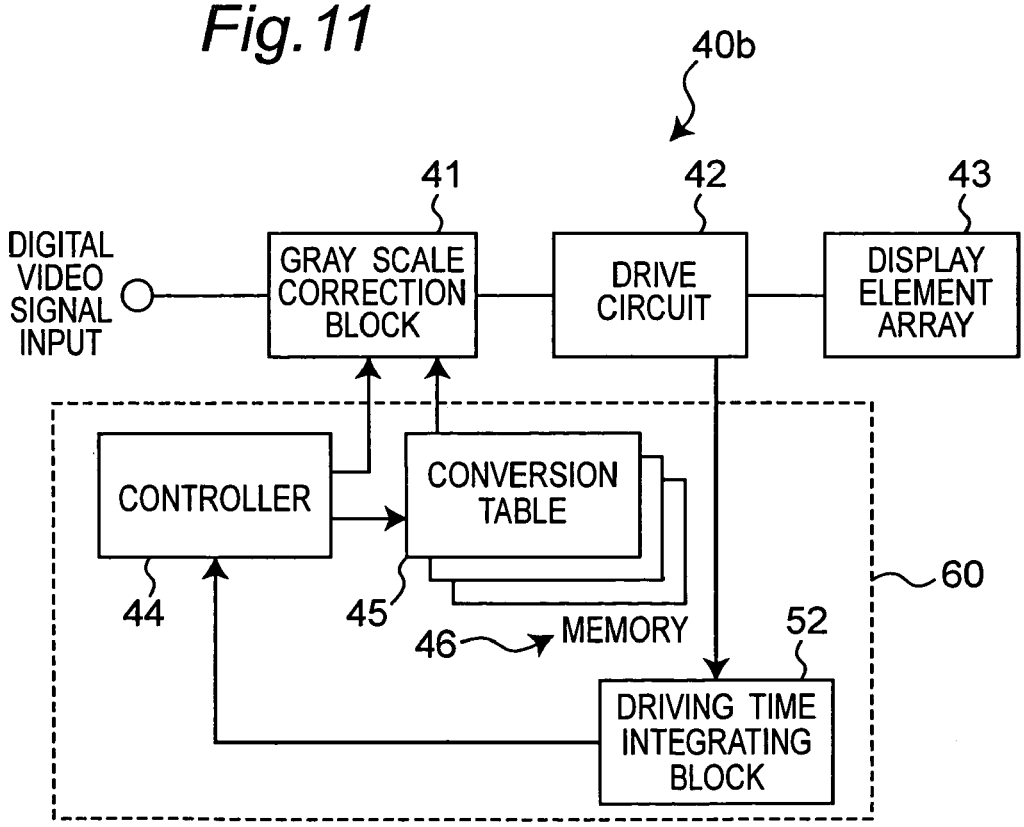
FIG. 11 is a block diagram of a display device having an aging compensating means.

Secondly, an aging compensating means 60 having an integrating means 52 which integrates driving time of the luminescent device, and a controller 44 which switches the conversion table 45 according to the driving time determined may be provided as shown in FIG. 11. In this case, considering display properties changing due to the aging effect, and providing another conversion table compensated as the applied electric field to the luminescent device, therefore, good display properties responding to the aging and effective utilization of electric power can be achieved.

Figure 12:
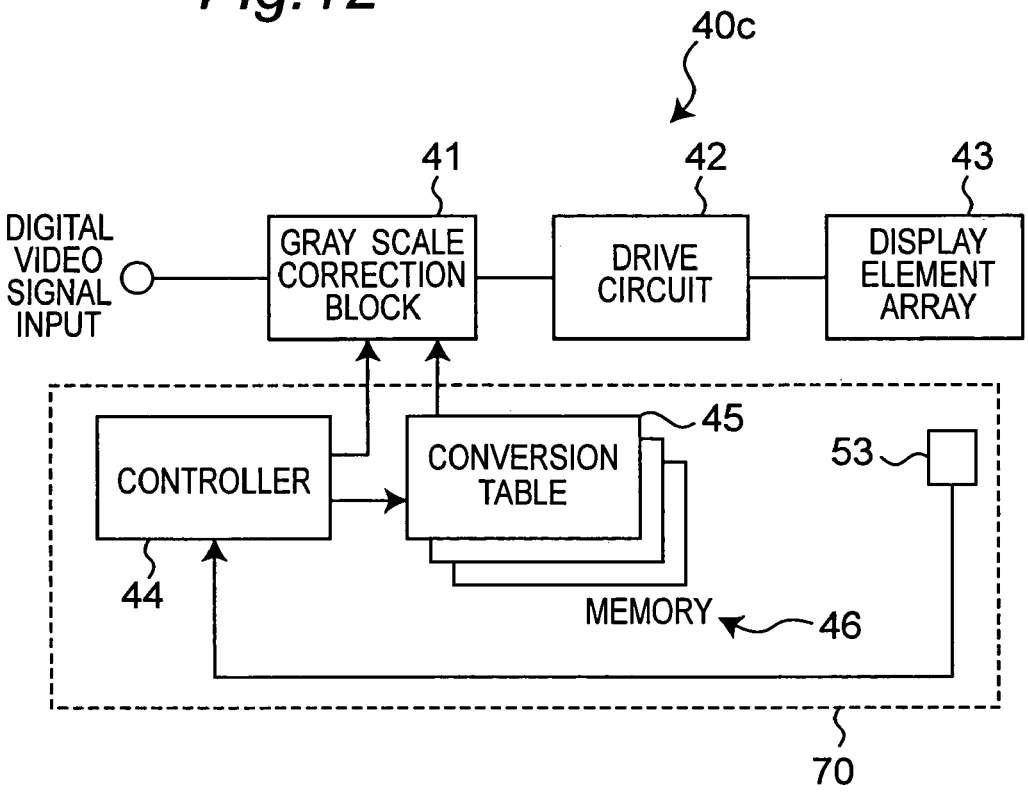
FIG. 12 is a block diagram of a display device having a ambient temperature compensating means.

Thirdly, an ambient temperature compensating means 70 having an ambient temperature detecting means 53 and a controller 44 which switches the conversion table 45 according to the ambient temperature determined may be provided as shown in FIG. 12. In this case, considering display properties changing due to the ambient temperature, and providing another conversion table compensated as the applied electric field to the luminescent device, therefore, good display properties responding to the ambient temperature and effective utilization of electric power can be achieved.

Figure 13:
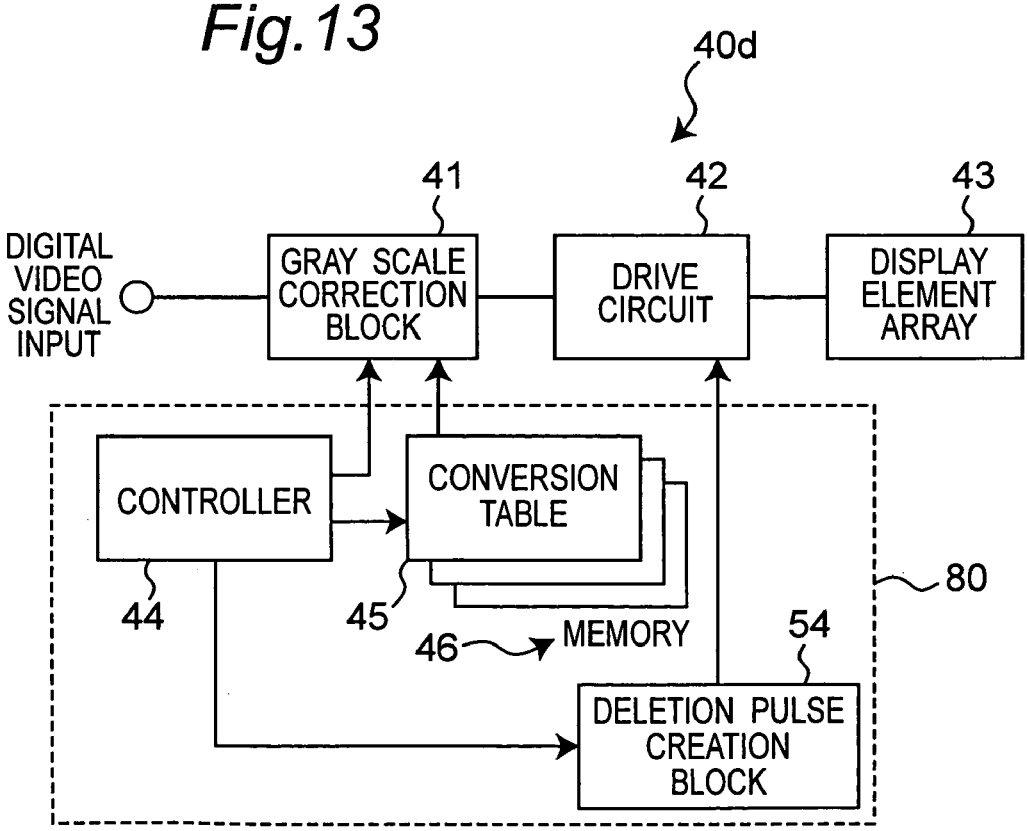
FIG. 13 is a block diagram of a display device having a deletion pulse creation block.

Fourthly, a deletion pulse creation means 54 may be provided as shown in FIG. 13. In this case, the deletion pulse may be inserted to the luminescence exciting pulse after the selected period of the luminescent device. Therefore, the residual polarization Pr can be discharged to a certain amount so that the display properties, more specifically, gray scale control at the next luminescent can be stabilized furthermore. It is noted that the deletion pulse may be repeated more than once so that the voltage lower than the threshold voltage for luminescence can be applied. Furthermore, the pulse having a shorter pulse width or a lower driving frequency may be combined.

SECOND EMBODIMENT

A luminescent device according to a second embodiment of the present invention is described next. This luminescent device differs from the device of the first embodiment in that it uses tantalum oxide ($Ta_2O_5$) film instead of barium titanate ($BaTiO_3$) in the ferroelectric layer.

The coercive electric field Ec of this tantalum oxide ferroelectric layer is approximately 25 kV/cm, and residual dielectric polarization Pr is approximately 3 $\mu C/cm^2$. The tantalum oxide ($Ta_2O_5$) film was formed by sputtering. Luminance of 410 $cd/m^2$ was achieved by applying a 220-V external voltage between two electrodes. As will be known from FIG. 4, output luminance changes gradually over a wide applied voltage range of 180 V to 220 V, and 256 gray scale control is therefore possible by controlling the applied voltage.

Gray scale passive matrix drive can also be used with this display device to achieve 256 gray scale control with good reproducibility by controlling the voltage or pulse height of the external electric field pulses applied when scanning the next frame n' according to the voltage or pulse height of the external electric field pulses applied to the data electrode when scanning the previous frame n−1 in the gray scale correction block shown in FIG. 7 between frames n−1 and n.

More specifically, 256 gray scale control with good reproducibility is possible by controlling the applied external electric field by providing a frame memory function in a display device having luminescent devices according to the present invention.

THIRD EMBODIMENT

A luminescent device according to a third embodiment of the present invention is described next. This luminescent device differs from the device of the first embodiment in that it uses lead titanate ($PbTiO_3$) instead of barium titanate ($BaTiO_3$) in the ferroelectric layer.

The coercive electric field Ec of this lead titanate ferroelectric layer is approximately 20 kV/cm, and residual dielectric polarization Pr is approximately 19 $\mu C/cm^2$. The lead titanate ($PbTiO_3$) film was formed by EB vapor deposition. Relatively high luminance of 550 $cd/m^2$ was achieved by applying a 220-V external voltage between two electrodes. Output luminance changes gradually over a wide applied voltage range of 195 V to 220 V, and 256 gray scale control is therefore possible by controlling the applied voltage.

FOURTH EMBODIMENT

A luminescent device according to a fourth embodiment of the present invention is described next. This luminescent device differs from the device of the first embodiment in that it uses samarium oxide ($Sm_2O_3$) instead of barium titanate ($BaTiO_3$) in the ferroelectric layer.

The coercive electric field Ec of this samarium oxide ferroelectric layer is approximately 20 kV/cm, and residual dielectric polarization Pr is approximately 3 $\mu C/cm^2$. The samarium oxide film was formed by EB vapor deposition. Luminance of 400 $cd/m^2$ was achieved by applying a 220-V external voltage between two electrodes. Output luminance changes gradually over a wide applied voltage range of 195 V to 220 V, and 256 gray scale control is therefore possible by controlling the applied voltage.

Gray scale passive matrix drive can also be used with this display device to achieve 256 gray scale control with good reproducibility by controlling the voltage or pulse height of the external electric field pulses applied when scanning the next frame n' according to the voltage or pulse height of the external electric field pulses applied to the data electrode when scanning the previous frame n−1 in the gray scale correction block shown in FIG. 7 between frames n−1 and n.

More specifically, 256 gray scale control with good reproducibility is possible by controlling the applied external electric field by providing a frame memory function in a display device having luminescent devices according to the present invention.

FIFTH EMBODIMENT

A luminescent device according to a fifth embodiment of the present invention is described next. This luminescent device differs from the device of the first embodiment in that it uses a mixed composition of lead titanate ($PbTiO_3$) and silicon oxynitride (SiON) instead of barium titanate ($BaTiO_3$) in the ferroelectric layer.

The coercive electric field Ec of a film made from lead titanate and silicon oxynitride is approximately 20 kV/cm, and residual dielectric polarization Pr is approximately 3.5 $\mu C/cm^2$. The film of lead titanate and silicon oxide was formed by sputtering. Lead titanate ($PbTiO_3$) and silicon oxynitride (SiON) were mixed at a weight ratio 4:1.

High luminance of 540 $cd/m^2$ was achieved by applying a 220-V external voltage between two electrodes. Output luminance changes gradually over a wide applied voltage range of 180 V to 220 V, and 256 gray scale control is therefore possible by controlling the applied voltage.

SIXTH EMBODIMENT

A luminescent device according to a sixth embodiment of the present invention is described next. This luminescent device differs from the device of the first embodiment in that it uses a mixed composition of barium tantalate ($BaTiO_3$) and silicon oxide ($SiO_2$) instead of barium titanate ($BaTiO_3$) in the ferroelectric layer.

The coercive electric field Ec of a film made from barium tantalate and silicon oxide is approximately 25 kV/cm, and residual dielectric polarization Pr is approximately 3 $\mu C/cm^2$. The film of barium tantalate and silicon oxide was formed by sputtering. The composition was a weight ratio of eight parts barium tantalate to one part silicon oxide. Luminance of 400 $cd/m^2$ was achieved by applying a 220-V external charge to two electrodes.

Gray scale passive matrix drive can also be used with this display device to achieve 256 gray scale control with good reproducibility by controlling the voltage or pulse height of the external electric field pulses applied when scanning the next frame n' according to the voltage or pulse height of the external electric field pulses applied to the data electrode when scanning the previous frame n−1 in the gray scale correction block shown in FIG. 7 between frames n−1 and n.

More specifically, 256 gray scale control with good reproducibility is possible by controlling the applied external electric field by providing a frame memory function in a display device having luminescent devices according to the present invention.

SEVENTH EMBODIMENT

A luminescent device according to a seventh embodiment of the present invention is described next. This luminescent device differs from the device of the first embodiment in that it uses a mixture of lead titanate ($PbTiO_3$) and silicon oxide ($SiO_2$) instead of barium titanate ($BaTiO_3$) in the ferroelectric layer.

The coercive electric field Ec of this lead titanate and silicon oxide film is approximately 25 kV/cm, and residual dielectric polarization Pr is approximately 3.5 μC/cm$^2$. The lead titanate and silicon oxide film was formed by sputtering. Relatively high luminance of 550 cd/m$^2$ was achieved by applying a 220-V external voltage between two electrodes. The composition of the film was eight parts lead titanate and one part silicon oxide on weight ratio basis. Luminance of 690 cd/m$^2$ was achieved by applying a 220-V external voltage between two electrodes.

Gray scale passive matrix drive can also be used with this display device to achieve 256 gray scale control with good reproducibility by controlling the voltage or pulse height of the external electric field pulses applied when scanning the next frame n' according to the voltage or pulse height of the external electric field pulses applied to the data electrode when scanning the previous frame n−1 in the gray scale correction block shown in FIG. 7 between frames n−1 and n.

More specifically, 256 gray scale control with good reproducibility is possible by controlling the applied external electric field by providing a frame memory function in a display device having luminescent devices according to the present invention.

EIGHTH EMBODIMENT

A luminescent device according to an eighth embodiment of the present invention is described next. This luminescent device differs from the device of the first embodiment in that it uses a mixed composition of lead titanate ($PbTiO_3$) and silicon oxynitride (SiON) instead of barium titanate in the ferroelectric layer.

The coercive electric field Ec of a film made from lead titanate and silicon oxynitride is approximately 25 kV/cm, and residual dielectric polarization Pr is approximately 5 μC/cm$^2$. The film of lead titanate and silicon oxynitride was formed by sputtering. $PbTiO_3$ and SiON were mixed at a weight ratio of 8:1

Luminance of 720 cd/m$^2$ was achieved by applying a 220-V external voltage between two electrodes.

NINTH EMBODIMENT

Figure 9:
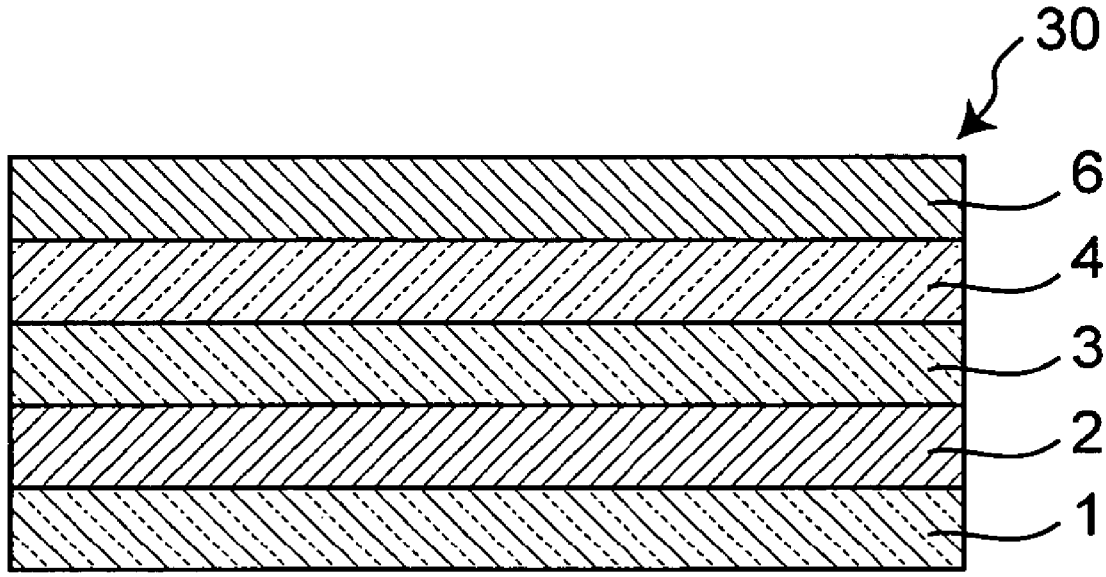
FIG. 9 is a section view of a luminescent device according to a ninth embodiment of the present invention.

A luminescent device according to a ninth embodiment of the present invention is described below with reference to FIG. 9. FIG. 9 is a schematic section view of the structure of this luminescent device 30. This luminescent device 30 is an inorganic EL device using a luminescent inorganic material as the luminescent element. The luminescent device 30 differs from the first embodiment in that the device has only one dielectric layer 3 formed on one side of the phosphor layer 4. Described with respect to the relative positions of these layers, this luminescent device 30 is manufactured by sequentially laminating to a support substrate 1: first electrodes 2, first ferroelectric layer 3, phosphor layer 4, and then second electrodes 6. The first electrode 2 is a metal electrode, and the second electrode 6 is transparent electrode. Therefore, luminescence from the luminescent inorganic material is output through the second electrode 6.

Preferably, the device 30 may be sealed fully or partially by sealing material. The sealing material may include, for example, plastics such as polyethylene terephthalate, polyethylene, polypropylene, polyimide, polyamide, nylon, glass, quarts, and ceramics. When the device is sealed, the device has a good moisture resistance, and has a long life.

Additionally, the first electrode 2 may be colored in black. When the first electrode 2 is colored in black, incident light from outside in the device through the first electrode 2 can be absorbed within the first electrode 2 so that the first electrode 2 can restrain the light from reflecting on the second electrode 6. Therefore, the device has a good contrast against background brightness.

Alternatively, the support substrate and the first electrode 2 may be transparent, so that light from the luminescent inorganic material is output through the first electrode 2 or through each side of the first and second electrode 2, 6.

A method of manufacturing this luminescent device 30 is described next. This luminescent device 30 was manufactured using the following steps.

(a) A non-alkali substrate was used for the transparent support substrate 1, which is 1.7 mm thick.

(b) A Pd electrode paste was printed to form the first electrodes on substrate 1. The paste was then dried to acquire a substrate with a first electrode pattern 2.

(c) A ferroelectric layer 3 of barium titanate was then sputtered over the first electrode pattern 2 to form the ferroelectric layer 3. The coercive electric field Ec of this dielectric layer is approximately 20 kV/cm and the residual dielectric polarization Pr is approximately 4 μC/cm$^2$.

(d) A manganese-doped zinc sulfide phosphor layer 4 was then formed by EB vapor deposition on the resulting ferroelectric layer 3.

(e) An ITO transparent electrode layer 6 was then formed on the phosphor layer 4 by RF magnetron sputtering using an ITO target.

The luminescent device 30 was formed by these processes.

The coercive electric field Ec and residual dielectric polarization Pr of the ferroelectric layer 3 made from $BaTiO_3$ of the device 30 are the same for the first embodiment. Luminance of 520 cd/m$^2$ was achieved by applying a 220 V external voltage between two electrodes.

More specifically, 256 gray scale control with good reproducibility is possible by controlling the applied external filed by providing a frame memory function in a display device having luminescent devices of this embodiment as well as the first embodiment.

TENTH EMBODIMENT

A luminescent device according to a tenth embodiment is described below. This comparison differs from a luminescent device according to the ninth embodiment of the invention in that $Ta_2O_5$ is used instead of barium titanate ($BaTiO_3$) as the ferroelectric layer.

The coercive electric field Ec of this film made from $Ta_2O_5$, residual dielectric polarization Pr, and fabrication method of the film are the same for second embodiment. Luminance of 400 cd/$m^2$ was achieved by applying a 220-V external voltage between two electrodes.

More specifically, 256 gray scale control with good reproducibility is possible by controlling the applied external filed by providing a frame memory function in a display device having luminescent devices of this embodiment as well as the ninth embodiment.

ELEVENTH EMBODIMENT

A luminescent device according to a eleventh embodiment is described below. This comparison differs from a luminescent device according to the ninth embodiment of the invention in that $Sm_2O_3$ is used instead of barium titanate ($BaTiO_3$) as the ferroelectric layer.

The coercive electric field Ec of this film made from $Sm_2O_3$, residual dielectric polarization Pr, and fabrication method of the film are the same for fourth embodiment. Luminance of 400 cd/$m^2$ was achieved by applying a 220-V external voltage between two electrodes.

More specifically, 256 gray scale control with good reproducibility is possible by controlling the applied external filed by providing a frame memory function in a display device having luminescent devices of this embodiment as well as the ninth embodiment.

TWELFTH EMBODIMENT

A luminescent device according to a twelfth embodiment is described below. This comparison differs from a luminescent device according to the ninth embodiment of the invention in that a mixture of $PbTiO_3$ and SiON is used instead of barium titanate ($BaTiO_3$) as the ferroelectric layer.

The mixture ratio of $PbTiO_3$ and SiON, the coercive electric field Ec of this film made from the mixed composition of $PbTiO_3$ and SiON, residual dielectric polarization Pr, and fabrication method of the film are the same for fifth embodiment. Luminance of 490 cd/$m^2$ was achieved by applying a 220-V external voltage between two electrodes.

More specifically, 256 gray scale control with good reproducibility is possible by controlling the applied external filed by providing a frame memory function in a display device having luminescent devices of this embodiment as well as the ninth embodiment.

THIRTEENTH EMBODIMENT

A luminescent device according to a thirteenth embodiment is described below. This comparison differs from a luminescent device according to the ninth embodiment of the invention in that a mixture of $PbTiO_3$ and SiON is used instead of barium titanate ($BaTiO_3$) as the ferroelectric layer.

The mixture ratio of $PbTiO_3$ and SiON, the coercive electric field Ec of this film made from the mixed composition of $PbTiO_3$ and SiON, residual dielectric polarization Pr, and fabrication method of the film are the same for eighth embodiment. Luminance of 620 cd/$m^2$ was achieved by applying a 220-V external voltage between two electrodes.

More specifically, 256 gray scale control with good reproducibility is possible by controlling the applied external filed by providing a frame memory function in a display device having luminescent devices of this embodiment as well as the ninth embodiment.

First Comparison Sample

A luminescent device according to a first comparison sample is described below. This comparison differs from a luminescent device according to the first embodiment of the invention in that a dielectric layer of silicon oxide is used instead of barium titanate as the ferroelectric layer.

The coercive electric field Ec of a dielectric film made from silicon oxide is approximately 60 kV/cm, and residual dielectric polarization Pr is approximately 2 μC/$cm^2$. The film of silicon oxide was formed by sputtering. Luminance of 170 cd/$m^2$ was achieved by applying a 220-V external voltage between two electrodes.

Figure 4:
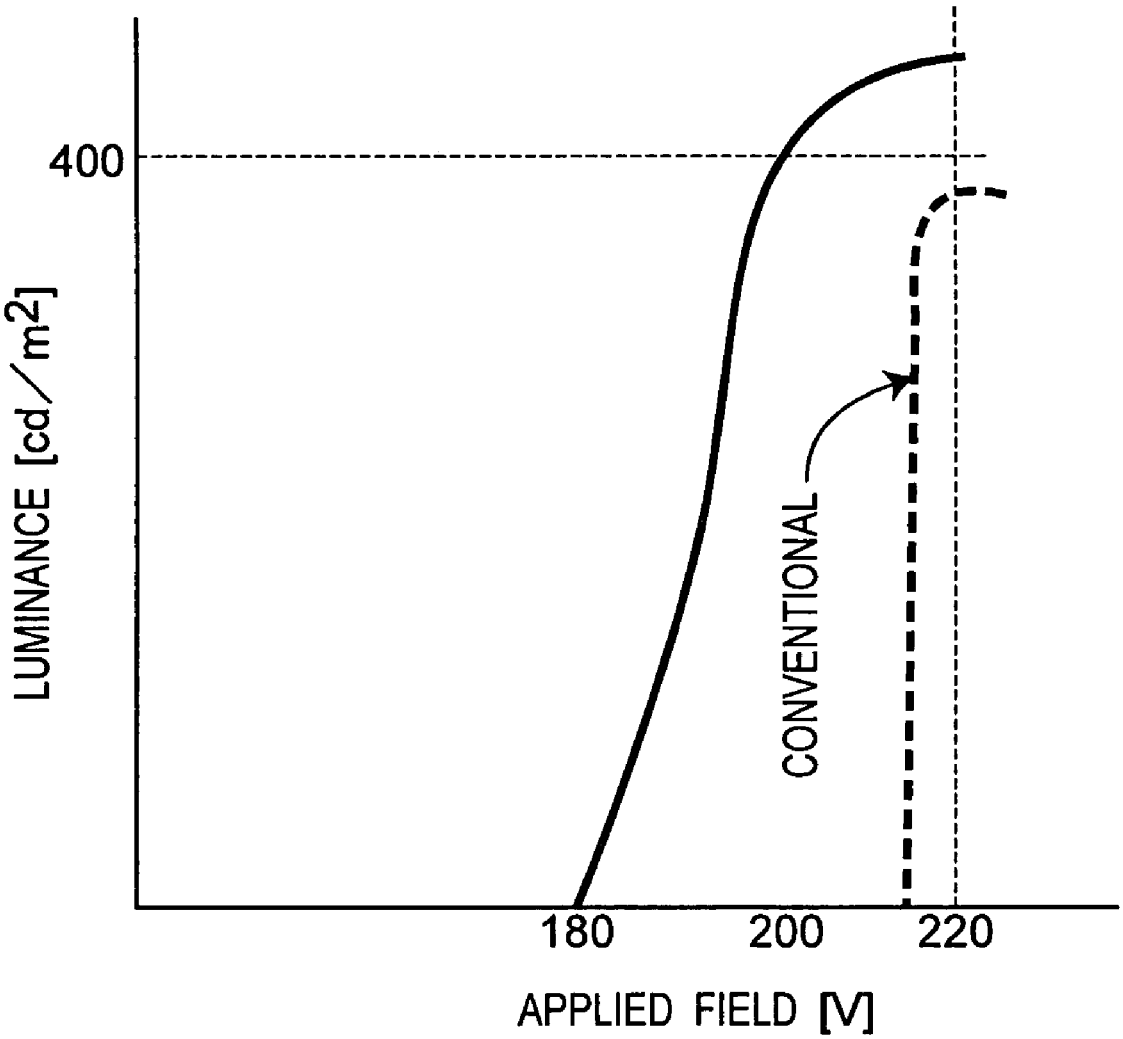
FIG. 4 is a graph of the relationship between the external applied voltage and luminance in the first embodiment of the invention and a first comparison sample.
Figure 5:
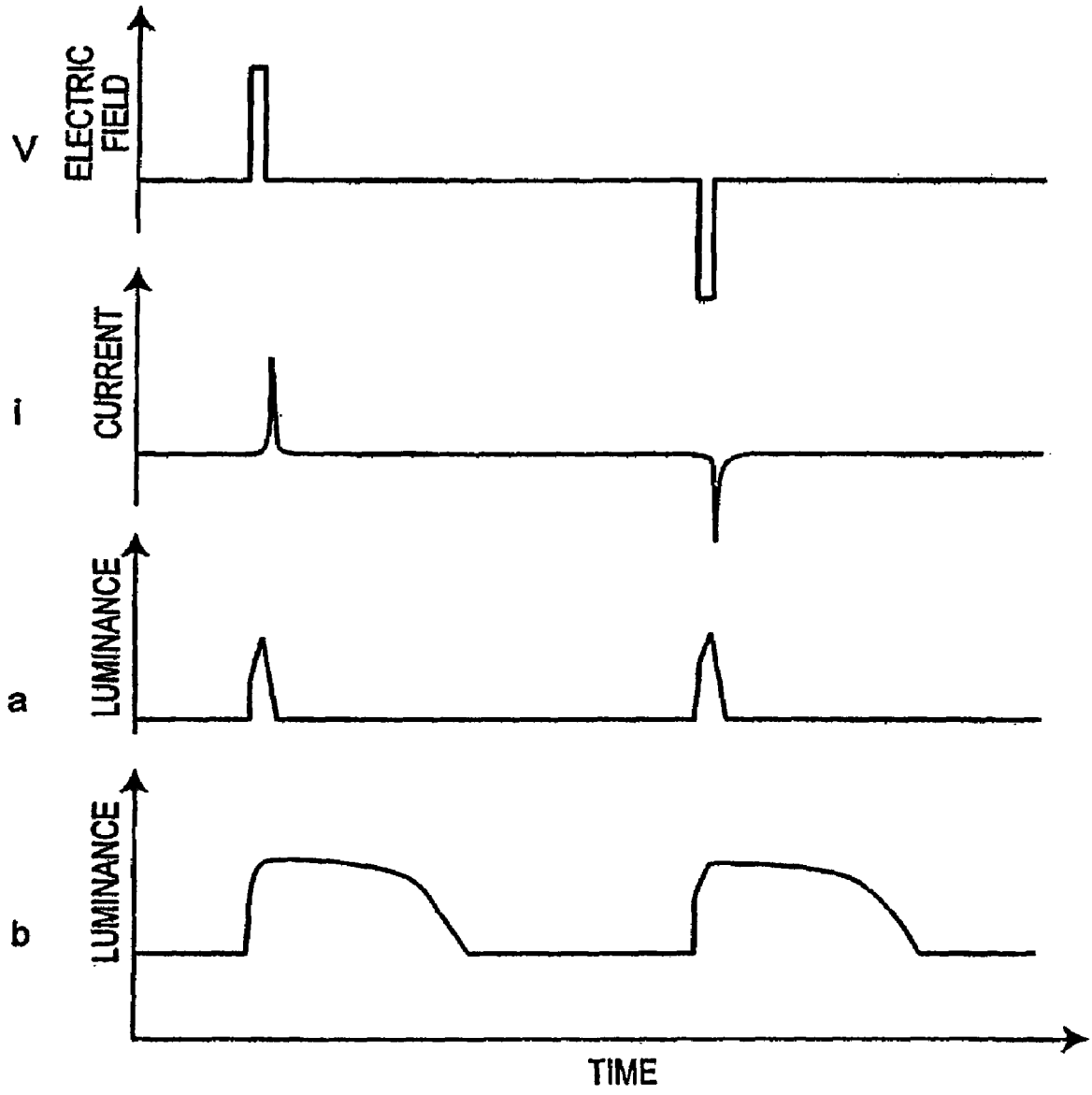
FIG. 5 is a graph of the time changes of current "i" and the output luminance of samples "a" and "b" when a pulse "V" is applied to the luminescent device as the external electric field.
Figure 6:
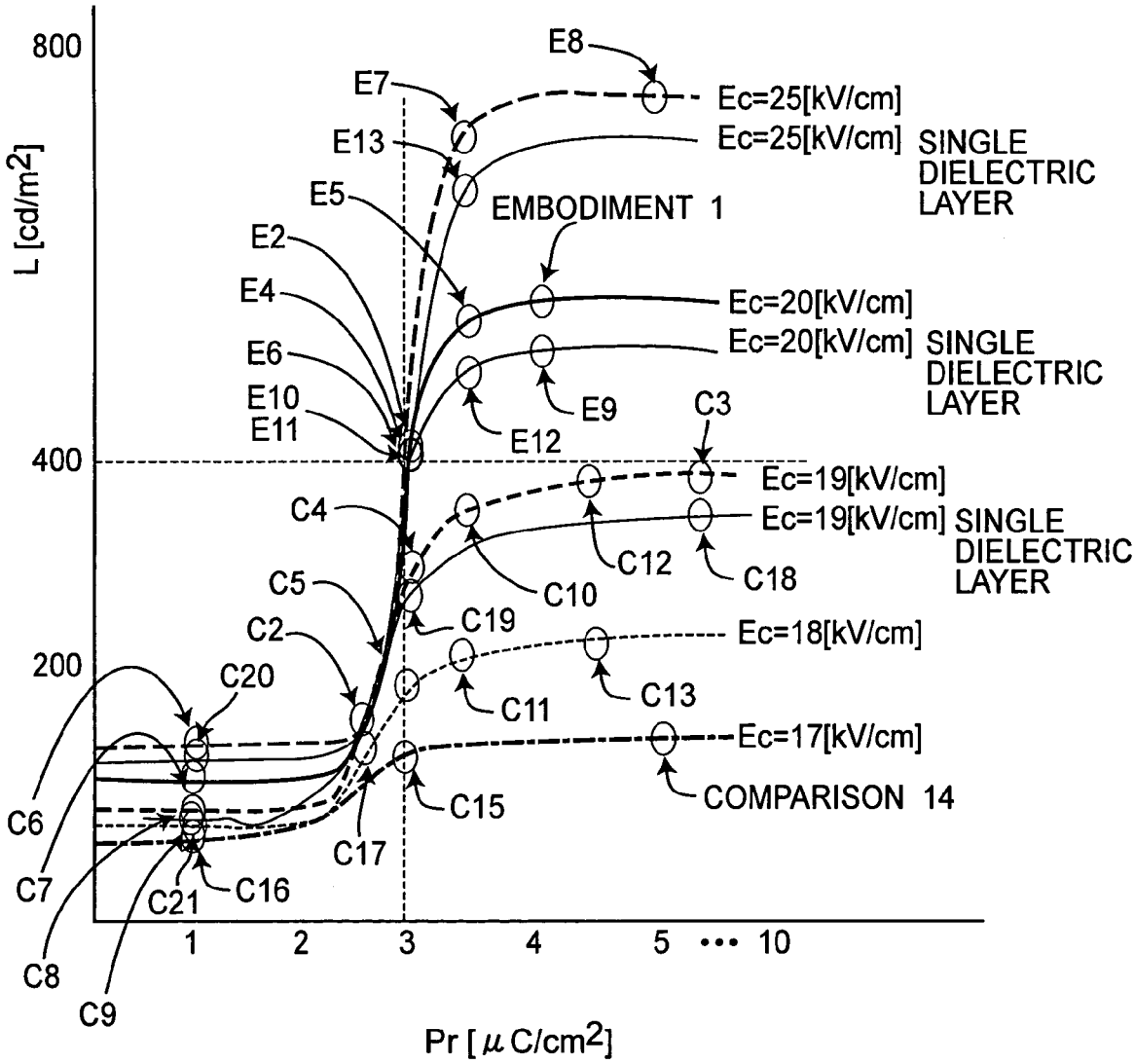
FIG. 6 is a graph of the output luminance measured when the same external electric field was applied to luminescent devices manufactured using various ferroelectrics of different coercive electric field Ec and residual dielectric polarization Pr.

As will be known from FIG. 4, the luminance of a luminescent device according to this first comparison changes in a range of a 215-V to 220-V applied external voltage, luminance can therefore not be controlled in 256 gradations by means of the external voltage, and output luminance is low. This luminescent device can therefore not be used in a television display device, for example.

Second Comparison Sample

A luminescent device according to a second comparison sample is described below. This comparison differs from a luminescent device according to the first embodiment of the invention in that a mixture of $SrTiO_3$ and silicon oxide is used instead of barium titanate as the ferroelectric layer.

The coercive electric field Ec of a film made from a mixed composition of $SrTiO_3$ and silicon oxide is approximately 20 kV/cm, and residual dielectric polarization Pr is approximately 2.5 μC/$cm^2$. The film of strontium titanate $SrTiO_3$ and silicon oxide was formed by sputtering. Strontium titanate $SrTiO_3$ and silicon oxide were mixed at a weight ratio of 4:1. Luminance of 160 cd/m2 was achieved by applying a 220-V external voltage between two electrodes.

Third Comparison Sample

A luminescent device according to a third comparison sample is described below. This comparison differs from a luminescent device according to the first embodiment of the invention in that a mixture of $SrTiO_3$ and SiON is used instead of barium titanate as the ferroelectric layer.

The coercive electric field Ec of a film made from a mixed composition of $SrTiO_3$ and SiON is approximately 19 kV/cm, and residual dielectric polarization Pr is approximately 6 μC/$cm^2$. The film of $SrTiO_3$ and SiON was formed by sputtering. $SrTiO_3$ and SiON were mixed at a weight ratio of 7:1. Luminance of 390 cd/$m^2$ was achieved by applying a 220-V external voltage between two electrodes.

Fourth Comparison Sample

A luminescent device according to a fourth comparison sample is described below. This comparison differs from a luminescent device according to the first embodiment of the invention in that a mixture of $PbTiO_3$ and SiON is used instead of barium titanate as the ferroelectric layer.

The coercive electric field Ec of a film made from a mixed composition of $PbTiO_3$ and SiON is approximately 19 kV/cm, and residual dielectric polarization Pr is approximately 3 μC/$cm^2$. The film of $PbTiO_3$ and SiON was formed by sputtering. $PbTiO_3$ and SiON were mixed at a weight ratio of 2:1. Luminance of 350 cd/$m^2$ was achieved by applying a 220-V external voltage between two electrodes.

Fifth Comparison Sample

A luminescent device according to a fifth comparison sample is described below. This comparison differs from a luminescent device according to the first embodiment of the invention in that a mixture of $PbTiO_3$ and SiON is used instead of barium titanate as the ferroelectric layer.

The coercive electric field Ec of this film made from a mixed composition of $PbTiO_3$ and SiON is approximately 18 kV/cm, and residual dielectric polarization Pr is approximately 3 μC/cm$^2$. The film of $PbTiO_3$ and SiON was formed by sputtering. $PbTiO_3$ and SiON were mixed at a weight ratio of 8:3. Luminance of 200 cd/m$^2$ was achieved by applying a 220-V external voltage between two electrodes.

Sixth Comparison Sample

A luminescent device according to a sixth comparison sample is described below. This comparison differs from a luminescent device according to the first embodiment of the invention in that a mixture of yttrium oxide and titanium oxide is used instead of barium titanate as the ferroelectric layer.

The coercive electric field Ec of this film made from a mixed composition of yttrium oxide and titanium oxide is approximately 25 kV/cm, and residual dielectric polarization Pr is approximately 1 μC/cm$^2$. The film of yttrium oxide and titanium oxide was formed by sputtering. Yttrium oxide and titanium oxide were mixed at a weight ratio of 5:1. Luminance of 150 cd/m$^2$ was achieved by applying a 220-V external voltage between two electrodes.

Seventh Comparison Sample

A luminescent device according to a seventh comparison sample is described below. This comparison differs from a luminescent device according to the first embodiment of the invention in that a mixture of samarium oxide and titanium oxide is used instead of barium titanate as the ferroelectric layer.

The coercive electric field Ec of this film made from a mixed composition of samarium oxide and titanium oxide is approximately 20 kV/cm, and residual dielectric polarization Pr is approximately 1 μC/cm$^2$. The film of samarium oxide and titanium oxide was formed by sputtering. Samarium oxide and titanium oxide were mixed at a weight ratio of 5:1. Luminance of 130 cd/m$^2$ was achieved by applying a 220-V external voltage between two electrodes.

Eighth Comparison Sample

A luminescent device according to an eighth comparison sample is described below. This comparison differs from a luminescent device according to the first embodiment of the invention in that a mixture of tantalum oxide and titanium oxide is used instead of barium titanate as the ferroelectric layer.

The coercive electric field Ec of this film made from a mixed composition of tantalum oxide and titanium oxide is approximately 19 kV/cm, and residual dielectric polarization Pr is approximately 1 μC/cm$^2$. The film of tantalum oxide and titanium oxide was formed by sputtering. Tantalum oxide and titanium oxide were mixed at a weight ratio of 5:1. Luminance of 100 cd/m$^2$ was achieved by applying a 220-V external voltage between two electrodes.

Ninth Comparison Sample

A luminescent device according to a ninth comparison sample is described below. This comparison differs from a luminescent device according to the first embodiment of the invention in that a mixture of $PbNb_2O_6$ and titanium oxide is used instead of barium titanate as the ferroelectric layer.

The coercive electric field Ec of this film made from a mixed composition of $PbNb_2O_6$ and titanium oxide is approximately 18 kV/cm, and residual dielectric polarization Pr is approximately 1 μC/cm$^2$. The film of $PbNb_2O_6$ and titanium oxide was formed by sputtering. $PbNb_2O_6$ and titanium oxide were mixed at a weight ratio of 5:1. Luminance of 95 cd/m$^2$ was achieved by applying a 220-V external voltage between two electrodes.

Tenth Comparison Sample

A luminescent device according to a tenth comparison sample is described below. This comparison differs from a luminescent device according to the first embodiment of the invention in that a mixture of barium titanate and $PbNb_2O_6$ is used instead of barium titanate as the ferroelectric layer.

The coercive electric field Ec of this film made from a mixed composition of barium titanate and $PbNb_2O_6$ is approximately 19 kV/cm, and residual dielectric polarization Pr is approximately 3.5 μC/cm$^2$. The film of barium titanate and $PbNb_2O_6$ was formed by sputtering. Barium titanate and $PbNb_2O_6$ were mixed at a weight ratio of 4:1. Luminance of 370 cd/m$^2$ was achieved by applying a 220-V external voltage between two electrodes.

Eleventh Comparison Sample

A luminescent device according to an eleventh comparison sample is described below. This comparison differs from a luminescent device according to the first embodiment of the invention in that a mixture of barium titanate ($BaTiO_3$) and titanium oxide ($TiO_2$) is used instead of barium titanate ($BaTiO_3$) as the ferroelectric layer.

The coercive electric field Ec of this film made from a mixed composition of barium titanate and titanium oxide is approximately 18 kV/cm, and residual dielectric polarization Pr is approximately 3.5 μC/cm$^2$. The film of barium titanate and titanium oxide was formed by sputtering. Barium titanate and titanium oxide were mixed at a weight ratio of 7:1. Luminance of 210 cd/m$^2$ was achieved by applying a 220-V external voltage between two electrodes.

Twelfth Comparison Sample

A luminescent device according to a twelfth comparison sample is described below. This comparison differs from a luminescent device according to the first embodiment of the invention in that a mixture of barium tantalate ($BaTiO_3$) and $PbNb_2O_6$ is used instead of barium titanate ($BaTiO_3$) as the ferroelectric layer.

The coercive electric field Ec of this film made from a mixed composition of barium tantalate and $PbNb_2O_6$ is approximately 19 kV/cm, and residual dielectric polarization Pr is approximately 4.5 μC/cm$^2$. The film of barium tantalate and $PbNb_2O_6$ was formed by sputtering. Barium tantalate and $PbNb_2O_6$ were mixed at a weight ratio of 4:1. Luminance of 385 cd/m$^2$ was achieved by applying a 220-V external voltage between two electrodes.

Thirteenth Comparison Sample

A luminescent device according to a thirteenth comparison sample is described below. This comparison differs from a luminescent device according to the first embodiment of the invention in that a mixture of barium tantalate ($BaTiO_3$) and titanium oxide ($TiO_2$) is used instead of barium titanate ($BaTiO_3$) as the ferroelectric layer.

The coercive electric field Ec of this film made from a mixed composition of barium tantalate and titanium oxide is approximately 18 kV/cm, and residual dielectric polarization Pr is approximately 4.5 μC/cm$^2$. The film of barium tantalate and titanium oxide was formed by sputtering. Barium tantalate and titanium oxide were mixed at a weight ratio of 7:1. Luminance of 220 cd/m$^2$ was achieved by applying a 220-V external voltage between two electrodes.

Fourteenth Comparison Sample

A luminescent device according to a fourteenth comparison sample is described below. This comparison differs from a luminescent device according to the first embodiment of the invention in that a mixture of $PbNb_2O_6$ and samarium oxide ($Sm_2O_3$) is used instead of barium titanate ($BaTiO_3$) as the ferroelectric layer.

The coercive electric field Ec of this film made from a mixed composition of $PbNb_2O_6$ and samarium oxide is approximately 17 kV/cm, and residual dielectric polarization Pr is approximately 5 μC/cm$^2$. The film of $PbNb_2O_6$ and samarium oxide was formed by sputtering. $PbNb_2O_6$ and samarium oxide were mixed at a weight ratio of 4:1. Luminance of 150 cd/m$^2$ was achieved by applying a 220-V external voltage between two electrodes.

Fifteenth Comparison Sample

A luminescent device according to a fifteenth comparison sample is described below. This comparison differs from a luminescent device according to the first embodiment of the invention in that a mixture of $PbNb_2O_6$ and silicon oxide ($SiO_2$) is used instead of barium titanate ($BaTiO_3$) as the ferroelectric layer.

The coercive electric field Ec of this film made from a mixed composition of $PbNb_2O_6$ and silicon oxide is approximately 17 kV/cm, and residual dielectric polarization Pr is approximately 3 μC/cm$^2$. The film of $PbNb_2O_6$ and silicon oxide was formed by sputtering. $PbNb_2O_6$ and silicon oxide were mixed at a weight ratio of 9:1. Luminance of 140 cd/m$^2$ was achieved by applying a 220-V external voltage between two electrodes.

Sixteenth Comparison Sample

A luminescent device according to a sixteenth comparison sample is described below. This comparison differs from a luminescent device according to the first embodiment of the invention in that a mixture of barium tantalate ($BaTiO_3$) and titanium oxide ($TiO_2$) is used instead of barium titanate ($BaTiO_3$) as the ferroelectric layer.

The coercive electric field Ec of this film made from a mixed composition of barium tantalate and titanium oxide is approximately 17 kV/cm, and residual dielectric polarization Pr is approximately 1 μC/cm$^2$. The film of barium tantalate and titanium oxide was formed by sputtering. Barium tantalate and titanium oxide were mixed at a weight ratio of 2:1. Luminance of 90 cd/m$^2$ was achieved by applying a 220-V external voltage between two electrodes.

Seventeenth Comparison Sample

A luminescent device according to a seventeenth comparison sample is described below. This comparison differs from a luminescent device according to the ninth embodiment of the invention in that a mixture of strontium titanate ($SrTiO_3$) and silicon oxide ($SiO_2$) is used instead of barium titanate ($BaTiO_3$) as the ferroelectric layer.

The mixture ratio of strontium titanate and silicon oxide, the coercive electric field Ec of this film made from the mixed composition of strontium titanate and silicon oxide, residual dielectric polarization Pr, and fabrication method of the film are the same for Comparison 2. Luminance of 150 cd/m$^2$ was achieved by applying a 220-V external voltage between two electrodes. The luminance of this comparison sample was lower than that of the ninth embodiment.

Eighteenth Comparison Sample

A luminescent device according to a eighteenth comparison sample is described below. This comparison differs from a luminescent device according to the ninth embodiment of the invention in that a mixture of strontium titanate and silicon oxynitride (SiON) is used instead of barium titanate as the ferroelectric layer.

The mixture ratio of strontium titanate and silicon oxynitride (SiON), the coercive electric field Ec of this film made from the mixed composition of strontium titanate and silicon oxynitride (SiON), residual dielectric polarization Pr, and fabrication method of the film are the same for Comparison 3. Luminance of 370 cd/m$^2$ was achieved by applying a 220-V external voltage between two electrodes. The luminance of this comparison sample was lower than that of the ninth embodiment.

Nineteenth Comparison Sample

A luminescent device according to a nineteenth comparison sample is described below. This comparison differs from a luminescent device according to the ninth embodiment of the invention in that a mixture of lead titanate and silicon oxide is used instead of barium titanate as the ferroelectric layer.

The mixture ratio of lead titanate and silicon oxide, the coercive electric field Ec of this film made from the mixed composition of lead titanate and silicon oxide, residual dielectric polarization Pr, and fabrication method of the film are the same for Comparison 4. Luminance of 300 cd/m$^2$ was achieved by applying a 220-V external voltage between two electrodes. The luminance of this comparison sample was lower than that of the ninth embodiment.

Twentieth Comparison Sample

A luminescent device according to a twentieth comparison sample is described below. This comparison differs from a luminescent device according to the ninth embodiment of the invention in that a mixture of yttrium oxide and titanium oxide is used instead of barium titanate as the ferroelectric layer.

The mixture ratio of yttrium oxide and titanium oxide, the coercive electric field Ec of this film made from the mixed composition of yttrium oxide ($Y_2O_3$) and titanium oxide, residual dielectric polarization Pr, and fabrication method of the film are the same for Comparison 6. Luminance of 160 cd/m$^2$ was achieved by applying a 220-V external voltage between two electrodes. The luminance of this comparison sample was lower than that of the ninth embodiment.

Twenty-first Comparison Sample

A luminescent device according to a twenty-first comparison sample is described below. This comparison differs from a luminescent device according to the ninth embodiment of the invention in that a mixture of $Ta_2O_5$ and $TiO_2$ is used instead of barium titanate as the ferroelectric layer.

The mixture ratio of $Ta_2O_5$ and $TiO_2$, the coercive electric field Ec of this film made from the mixed composition of $Ta_2O_5$ and $TiO_2$, residual dielectric polarization Pr, and fabrication method of the film are the same for Comparison 8. Luminance of 100 cd/m$^2$ was achieved by applying a 220-V external voltage between two electrodes. The luminance of this comparison sample was lower than that of the ninth embodiment.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

The invention claimed is:

1. A luminescent device comprising:

a phosphor layer containing a luminescent inorganic material;

first and second dielectric layers rendering the phosphor layer therebetween from the direction perpendicular to the surface, the dielectric layers having residual dielectric polarization in part of at least 3 μC/cm2 and a coercive electric field of at least 20 kV/cm; and first and second electrodes rendering the first and second dielectric layers therebetween from the direction perpendicular to the surface.

2. A luminescent device comprising:

a phosphor layer containing a luminescent inorganic material;

a dielectric layer provided on a surface of the phosphor layer, the dielectric layer having residual dielectric polarization in part of at least 3 μC/cm2 and a coercive electric field of at least 20 kV/cm; and first and second electrodes rendering the phosphor layer and the dielectric layer therebetween from the direction perpendicular to the surface.

3. A luminescent device according to claim 1 or claim 2, further comprising a support substrate for supporting the first electrodes or second electrodes on the surface.

4. A luminescent device according to claim 1, further comprising a control unit for controlling AC voltage applied between the first electrodes and second electrodes.

5. A display device comprising:

a luminescent array comprising a plurality of luminescent devices according to claim 1 arranged in a two-dimensional matrix;

a plurality of first electrodes extending parallel to a first direction that is parallel to the surface of the luminescent device array; and a plurality of second electrodes extending parallel to a second direction that is perpendicular to the first direction and parallel to the surface of the luminescent device array;

wherein at least one luminescent device is driven by applying an AC voltage between one first electrode and second electrode pair.

6. A control method for a display device having a luminescent device array comprising a plurality of luminescent devices according to claim 1 arranged in a two-dimensional matrix, a plurality of first electrodes extending parallel to a first direction that is parallel to the surface of the luminescent device array, a plurality of second electrodes extending parallel to a second direction that is perpendicular to the first direction and parallel to the surface of the luminescent device array, and driving at least one luminescent device by applying an AC voltage between one first electrode and second electrode pair, the control method comprising the steps of:

driving the luminescent devices by applying alternating positive and negative external electric fields between the first electrodes and second electrodes, and scanning the entire luminescent device array; and controlling the pulse height of pulses applied in the next scan according to the pulse height of pulses applied in the previous scan.

* * * * *